US006170220B1

(12) United States Patent
Moore, Jr.

(10) Patent No.: US 6,170,220 B1
(45) Date of Patent: Jan. 9, 2001

(54) INSULATED CONCRETE FORM

(76) Inventor: James Daniel Moore, Jr., 513 Coconut Isle, Fort Lauderdale, FL (US) 33301

( * ) Notice: Under 35 U.S.C. 154(b), the term of this patent shall be extended for 0 days.

(21) Appl. No.: 09/008,437

(22) Filed: Jan. 16, 1998

(51) Int. Cl.[7] ..... E04B 1/16

(52) U.S. Cl. ..... 52/741.13; 52/309.11; 52/309.12; 52/426; 52/562; 52/742.14; 52/745.09; 52/745.2

(58) Field of Search ..... 52/309.11, 309.12, 52/424, 425, 426, 562, 564, 565, 741.13, 742.14, 745.09, 745.2

(56) References Cited

U.S. PATENT DOCUMENTS

| | | | |
|---|---|---|---|
| D. 378,049 | 2/1997 | Boeshart | D8/354 |
| 963,776 | 7/1910 | Kosack . | |

(List continued on next page.)

FOREIGN PATENT DOCUMENTS

| | | |
|---|---|---|
| 826584 | 11/1969 | (CA) . |
| 1145584 | 5/1983 | (CA) . |
| 1154278 | 9/1983 | (CA) . |
| 1182304 | 2/1985 | (CA) . |
| 1194706 | 10/1985 | (CA) . |
| 1209364 | 8/1986 | (CA) . |
| 1233042 | 2/1988 | (CA) . |
| 1234701 | 4/1988 | (CA) . |
| 1244668 | 11/1989 | (CA) . |
| 1303377 | 6/1992 | (CA) . |
| 1304952 | 7/1992 | (CA) . |
| 2118343 | 10/1994 | (CA) . |
| 2219414 | 10/1997 | (CA) . |
| 28 04 402 | 8/1978 | (DE) . |

OTHER PUBLICATIONS

Design of KT–Semi–Precast Panels (including translation) (undated).

(List continued on next page.)

*Primary Examiner*—Beth A. Stephan
*Assistant Examiner*—Brian E. Glessner
(74) *Attorney, Agent, or Firm*—Needle & Rosenberg, P.C.

(57) ABSTRACT

An insulated concrete structure including at least one longitudinally-extending side panel and at least one web member partially disposed within the side panel. The web member extends from adjacent the external side of the side panel through and out of the interior surface of the side panel. The first embodiment of the present invention uses opposed side panels that form a cavity therebetween into which concrete is poured and cured. The second embodiment uses a single side panel as a form, onto which concrete is poured. Once the concrete cures on the single side panel, it is used as a tilt-up wall, floor, or roof panel.

2 Claims, 3 Drawing Sheets

U.S. PATENT DOCUMENTS

| | | | | |
|---|---|---|---|---|
| 1,053,231 | | 2/1913 | Schweikert | 52/426 |
| 1,069,821 | | 8/1913 | Sherwood et al. . | |
| 1,953,287 | | 4/1934 | Bemis . | |
| 1,973,941 | | 9/1934 | Anderson . | |
| 2,029,082 | | 1/1936 | Odam | 52/426 X |
| 2,248,348 | | 7/1941 | Hall | 52/426 |
| 2,316,819 | | 4/1943 | Tedrow . | |
| 2,750,648 | | 6/1956 | Hallock . | |
| 3,286,428 | | 11/1966 | Kay . | |
| 3,475,873 | | 11/1969 | Steadman . | |
| 3,782,049 | | 1/1974 | Sachs . | |
| 3,788,020 | | 1/1974 | Gregori . | |
| 3,902,296 | | 9/1975 | Thomas . | |
| 3,943,676 | * | 3/1976 | Ickes | 52/309.11 X |
| 3,985,329 | | 10/1976 | Liedgens . | |
| 4,177,617 | | 12/1979 | DeLucas et al. . | |
| 4,223,501 | | 9/1980 | DeLozier . | |
| 4,229,920 | * | 10/1980 | Lount | 52/309.12 |
| 4,604,843 | * | 8/1986 | Ott et al. | 52/426 |
| 4,655,014 | | 4/1987 | Krecke . | |
| 4,698,947 | * | 10/1987 | McKay | 52/309.11 X |
| 4,706,429 | | 11/1987 | Young . | |
| 4,730,422 | | 3/1988 | Young . | |
| 4,731,968 | | 3/1988 | Obino . | |
| 4,742,659 | | 5/1988 | Meilleur | 52/426 X |
| 4,765,109 | * | 8/1988 | Boeshart | 52/426 |
| 4,866,891 | | 9/1989 | Young | 52/426 X |
| 4,879,855 | | 11/1989 | Berrenberg . | |
| 4,884,382 | * | 12/1989 | Horobin | 52/309.12 X |
| 4,888,931 | | 12/1989 | Meilleur | 52/426 |
| 4,889,310 | * | 12/1989 | Boeshart | 52/309.12 X |
| 4,894,969 | | 1/1990 | Horobin . | |
| 4,901,494 | | 2/1990 | Miller et al. | 52/426 X |
| 4,936,540 | | 6/1990 | Boeshart . | |
| 4,949,515 | | 8/1990 | Krecke . | |
| 4,967,528 | | 11/1990 | Doran . | |
| 5,074,088 | | 12/1991 | Bergeron . | |
| 5,107,648 | | 4/1992 | Roby . | |
| 5,140,794 | | 8/1992 | Miller | 52/426 X |
| 5,371,990 | | 12/1994 | Salah Uddin . | |
| 5,390,459 | | 2/1995 | Mensen | 42/426 |
| 5,459,971 | * | 10/1995 | Sparkman | 52/309.11 X |
| 5,566,518 | | 10/1996 | Martin et al. | 52/426 |
| 5,570,552 | | 11/1996 | Nehring | 52/426 |
| 5,611,183 | * | 3/1997 | Kim | 52/426 |
| 5,625,989 | * | 5/1997 | Brubaker et al. | 52/309.12 |
| 5,657,600 | * | 8/1997 | Mensen | 52/309.12 X |
| 5,701,710 | * | 12/1997 | Tremelling | 52/565 X |
| 5,704,180 | * | 1/1998 | Boeck | 52/309.12 X |
| 5,735,093 | * | 4/1998 | Grutsch | 52/309.12 X |
| 5,896,714 | | 4/1999 | Cymbala et al. . | |

OTHER PUBLICATIONS

Promotion al advertisement for "Quad–Lock Insulated Forms," which appeared in Energy Source Builder #36, obtained from Building Technologies, Inc.'s website (Dec. 1994).

Promotional advertisement for "Thermalite" obtained from Thermalite, Inc.'s website (1997).

Promotional advertisement for "Reward" obtained from the internet (undated).

Promotional advertisement for "Polysteel Form" obtained from the internet (undated).

Promotional advertisement for "Isorast—Styropor Forms" obtained Hurricane Homes & Construction Inc.'s website (undated).

Promotional advertisement for "I.C.E. Block Insulating Concrete Form" obtained from Oikos' wobsite (undated).

Promotional advertisement for "The Greenblock System" obtained from Greenblock's website (undated).

Promotional advertisement for "Greenblock Building System" obtained from Greenblock's website (1996).

Promotional advertisement for "Keeva Concrete Foam Froam Wall System" obtained from Keeva's website (undated).

Promotional advertisement for Isorast Floor System (Jan. 1997).

W.A.M. Inc.'s brochure entitled "The ICE (Insulate Concrete Efficiently) Block" (undated).

Promotion al advertisement for "Quad–Lock Insulated Forms, " which appeared in Energy Source Builder #36, obtained from Building Technologies, Inc.'s website (Dec. 1994).

Promotional advertisement for "Thermalite" obtained from Thermalite, Inc.'s website (1997).

Promotional advertisement for "Reward" obtained from the internet (undated).

Promotional advertisement for "Polysteel Form" obtained from the internet (undated).

Promotional advertisement for "Isorast—Styropor Forms" obtained Hurricane Homes & Construction Inc.'s website (undated).

Promotional advertisement for "I.C.E. Block Insulating Concrete Form" obtained from Oikos' wobsite (undated).

Promotional advertisement for "The Greenblock System" obtained from Greenblock's website (undated).

Promotional advertisement for "Greenblock Building System" obtained from Greenblock's website (1996).

Promotional advertisement for "Keeva Concrete Foam Froam Wall System" obtained from Keeva's website (undated).

A Product Profile of the Consulwal™ Concrete Forming System entitled "Concrete Forming, Concrete Block Construction—A Faster Alternative." (Undated).

* cited by examiner

INSULATED CONCRETE FORM

BACKGROUND OF THE INVENTION

1. Field of the Invention

The present invention encompasses a building component used to make insulated concrete forms and, more particularly, to a system that can be used to make cast-in-place walls using two opposed side panels or tilt-up walls using a single side panel.

2. Background Art

Concrete walls in building construction are most often produced by first setting up two parallel form walls and pouring concrete into the space between the forms. After the concrete hardens, the builder then removes the forms, leaving the cured concrete wall.

This prior art technique has drawbacks. Formation of the concrete walls is inefficient because of the time required to erect the forms, wait until the concrete cures, and take down the forms. This prior art technique, therefore, is an expensive, labor-intensive process.

Accordingly, techniques have developed for forming modular concrete walls, which use a foam insulating material. The modular form walls are set up parallel to each other and connecting components hold the two form walls in place relative to each other while concrete is poured therebetween. The form walls, however, remain in place after the concrete cures. That is, the form walls, which are constructed of foam insulating material, are a permanent part of the building after the concrete cures. The concrete walls made using this technique can be stacked on top of each other many stories high to form all of a building's walls. In addition to the efficiency gained by retaining the form walls as part of the permanent structure, the materials of the form walls often provide adequate insulation for the building.

Although the prior art includes many proposed variations to achieve improvements with this technique, drawbacks still exist for each design. The connecting components used in the prior art to hold the walls are constructed of (1) plastic foam, (2) high density plastic, or (3) a metal bridge, which is a non-structural support, i.e., once the concrete cures, the connecting components serve no function. Also, these procedures also cannot be used to make floors or roof panels.

One embodiment of a connecting component is disclosed in U.S. Pat. No. 5,390,459, which issued to Mensen on Feb. 21, 1995 and which is incorporated herein by reference. This patent discloses "bridging members" that comprise end plates connected by a plurality of web members. The bridging members also use reinforcing ribs, reinforcing webs, reinforcing members extending from the upper edge of the web member to the top side of the end plates, and reinforcing members extending from the lower edge of the web member to the bottom side of the end plates. As one skilled in the art will appreciate, this support system is expensive to construct, which increases the cost of the formed wall.

SUMMARY OF THE INVENTION

The disadvantages of the prior art are overcome by the present invention, which provides an insulated concrete form comprising at least one longitudinally-extending side panel and at least one web member partially disposed within the side panel. The web member extends from adjacent the external surface of the side panel through and out of the interior surface of the side panel. Two embodiments of the present invention are described herein. The first embodiment uses opposed side panels that form a cavity therebetween into which concrete is poured and cured. The second embodiment uses a single side panel as a form, onto which concrete is poured. Once the concrete cures and bonds to the side panel, it is used as a tilt up wall, floor, or roof panel.

In the first embodiment, the web member is molded into a side panel, in which the web member projects beyond the interior surface of the side panel and facing, but does not touch, an opposing, identical side panel. The first embodiment also uses a connector which attaches to the two opposing web members, thereby bridging the gap between the two side panels for positioning the side panels relative to each other. The connectors preferably have apertures to hold horizontally disposed re-bar. The connectors also have different lengths, creating cavities of different widths for forming concrete walls having different thicknesses. The connectors are interchangeable so that the desired width of the wall can be set at the construction site.

The web member is also molded into a side panel for the second embodiment so that a portion of the web member projects beyond the interior surface of the side panel. In use, the side panel is first horizontally disposed so that the interior surface and portion of the web member extending therethrough are positioned upwardly. Forms are placed around the periphery of the side panel and concrete is then poured onto the interior surface. Once the concrete cures and bonds with the interior surface and the portion of the web member extending therethrough, the side panel and connected concrete can be used as a tilt-up wall, flooring member, or roof panel.

DETAILED DESCRIPTION OF THE INVENTION

The present invention is more particularly described in the following examples that are intended as illustrative only since numerous modifications and variations therein will be apparent to those skilled in the art. As used in the specification and in the claims, "a" can mean one or more, depending upon the context in which it is used. The preferred embodiment is now described with reference to the figures, in which like numbers indicate like parts throughout the figures.

As shown in FIGS. 1–5A, the present invention comprises a concrete form system 10 used for constructing buildings.

Figure 1:
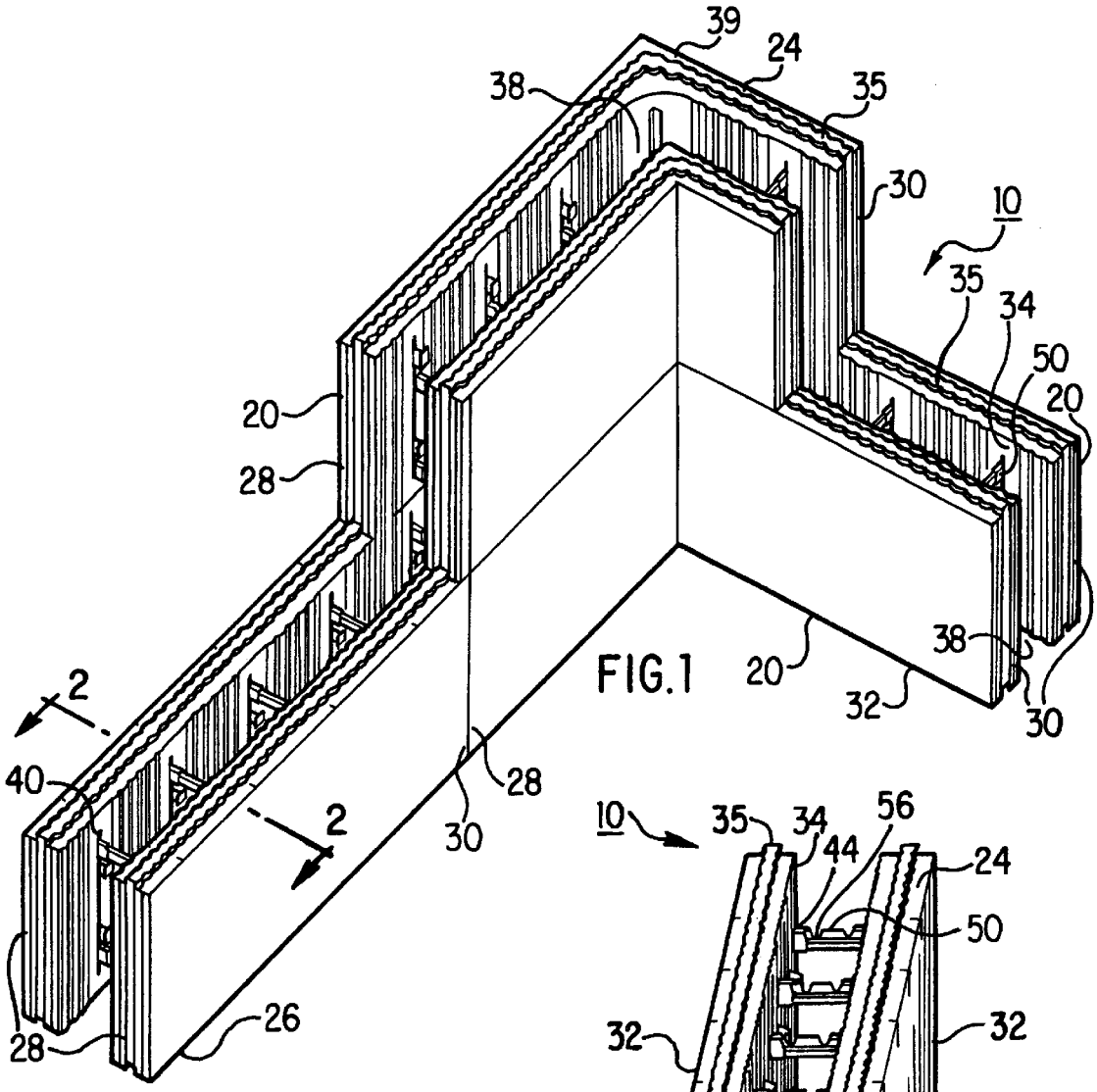
FIG. 1 is a perspective view of the first embodiment of the present invention.
Figure 2:
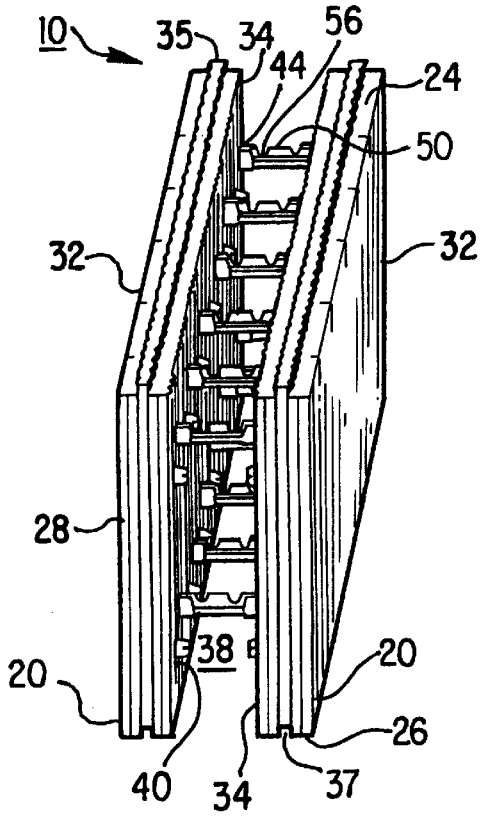
FIG. 2 is a perspective side view of a FIG. 1 taken along line 2—2.
Figure 2A:
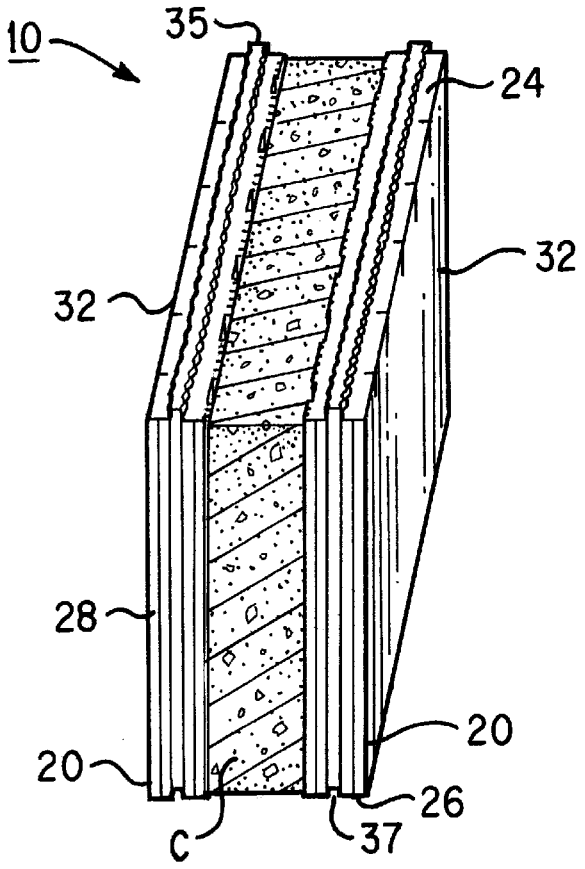
FIG. 2A is an alternative view of FIG. 2 showing concrete disposed between the two opposed side panels.

A first embodiment of the present invention, shown in FIGS. 1, 2, and 2A, comprises at least two opposed longitudinally-extending side panels 20, at least one web member 40 partially disposed within each of the side panels 20, and a connector 50 disposed between the side panels 20 for connecting the web members 40 to each other. As shown in FIG. 2A concrete C is poured between the side panels 20 so that it bonds with the side panels 20 and the web members 40. A second embodiment of the present invention, which is discussed in more detail below and shown in FIGS. 5 and 5A involves using a single side panel 20 that bonds with the concrete C, instead of using opposed side panels 20 on both sides of the concrete.

Each side panel 20 has, a top end 24, a bottom end 26, a first end 28, a second end 30, an exterior surface 32, and an interior surface 34. The presently preferred side panel 20 has a thickness (separation between the interior surface 34 and exterior surface 32) of approximately two and a half (2½) inches, a height (separation between the bottom end 26 and the top end 24) of sixteen (16) inches, and a length (separation between the first end 28 and second end 30) of forty-eight (48) inches. The dimensions can be altered, if desired, for different building projects, such as increasing the thickness of the side panel 20 for more insulation. Half sections of the side panels 20 can be used for footings.

Referring now to FIGS. 1 and 2, the interior surface 34 of one side panel 20 faces the interior surface 34 of another side panel 20 in the first embodiment and the opposed interior surfaces 34 are laterally spaced apart from each other a desired separation distance so that a cavity 38 is formed therebetween. Concret—in its fluid state—is poured into the cavity 38 and allowed to cure (i.e., harden) therein to form the wall as shown in FIG. 2A. Preferably, the opposed interior surfaces 34 are parallel to each other. The volume of concrete C received within the cavity 38 is defined by the separation distance between the interior surfaces 34, the height of the side panels 20, and the length of the side panels 20.

The side panels 20 are preferably constructed of polystyrene, specifically expanded polystyrene ("EPS"), which provides thermal insulation and sufficient strength to hold the poured concrete C until it substantially cures. The formed concrete wall using polystyrene with the poured concrete C has a high insulating value so that no additional insulation is usually required. In addition, the formed walls have a high impedance to sound transmission.

Figure 5A:
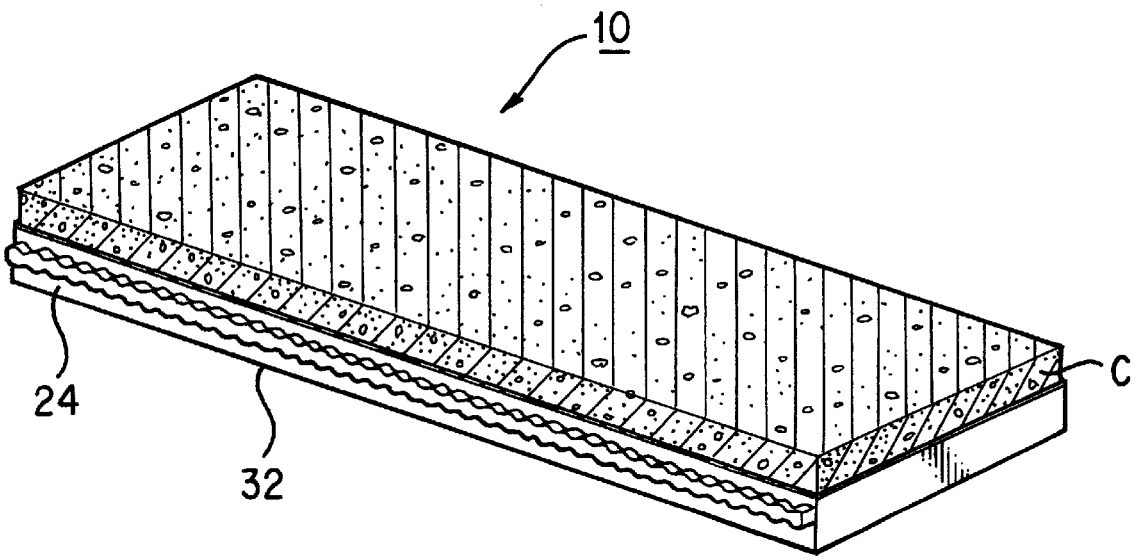
FIG. 5A is an alternative view of FIG. 5 showing concrete disposed on and connected to the side panel.
Figure 5:
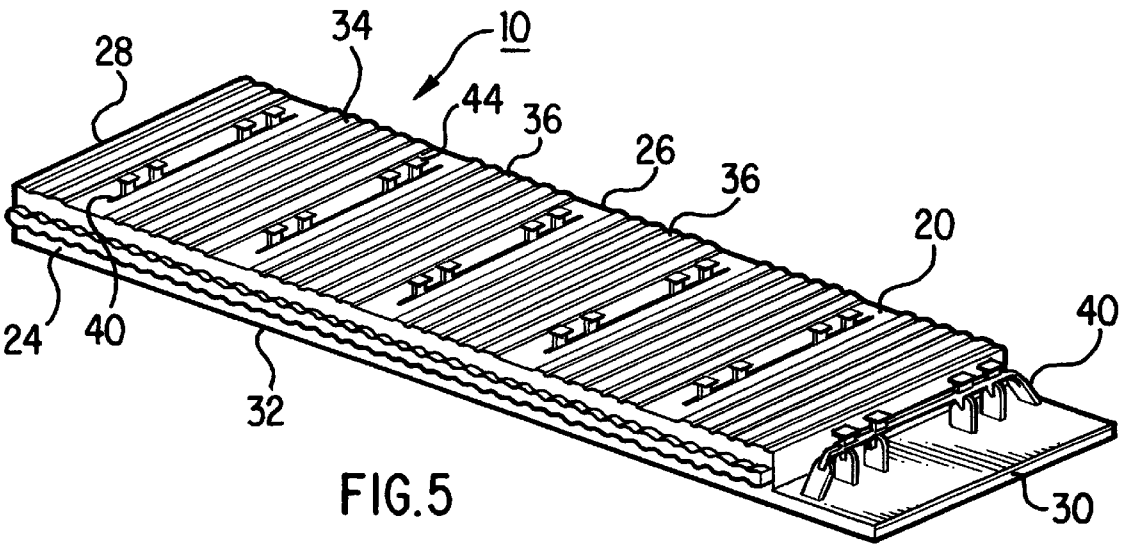
FIG. 5 is a perspective view of the side panel of the second embodiment of the present invention, in which a portion of the side panel is cut away to shown the body portion of the web member partially disposed therein.
Figure 3:
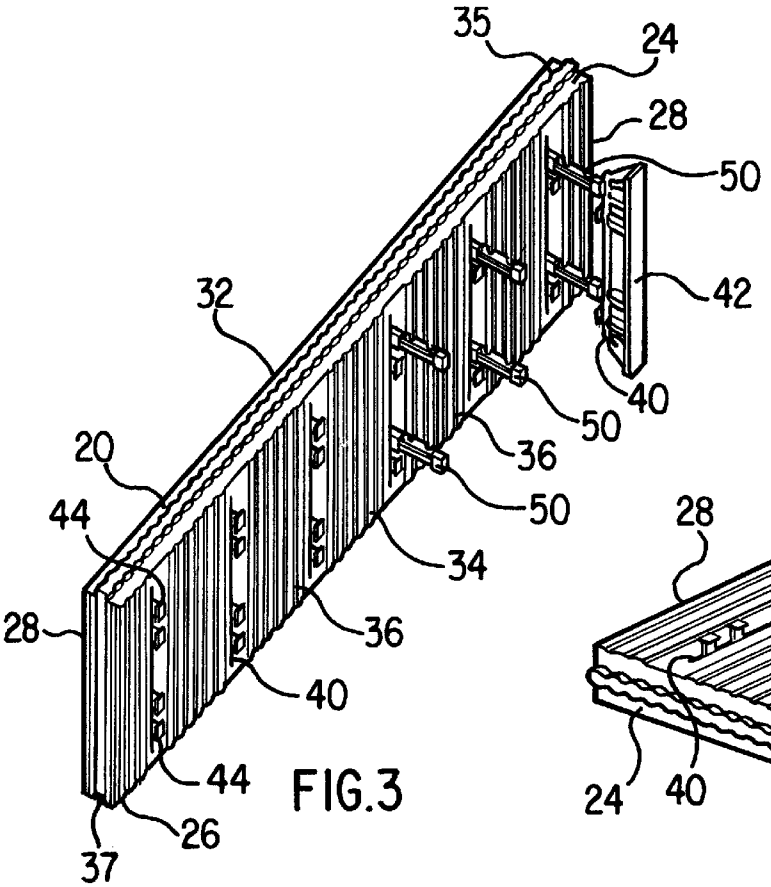
FIG. 3 is a perspective view of one side panel shown in FIG. 1, in which three web members show four attachment points extending through the interior surface of the side panel, two web members show two connectors attached to attachment points, and one web member shows two connectors and another web member attached thereto.

As best shown in FIGS. 3 and 5, the interior surface 34 preferably includes a series of indentations 36 therein to enhance the bond between the side panels 20 and concrete. To improve further the bond between the side panels 20 and the concrete C poured in the cavity 38, a portion of each of the web members 40 formed in the side panels 20 extends through the interior surface 34 of the side panels 20 into the cavity 38. A portion of each web member 40 is integrally formed within one side panel 20 and is also cured within the concrete C so that the web member 40 strengthens the connection between the side panel 20 and the concrete. That is, since the web member 40 is an integral part of the side panel 20, it "locks" the side panel 20 to the concrete C once the concrete C is poured and cures within the cavity 38.

As shown in FIGS. 1–3 and 5, each side panel 20 has at least one web member 40 formed into it. Preferably, the each web member 40 formed within a side panel 20 is separated a predetermined longitudinal distance, which is typically eight (8) inches. Based on the preferred length of the side panel 20 of forty-eight inches, six web members 40 are formed within each side panel 20, as shown in FIGS. 3 and 5.

The portions of each web member 40 that extend through the interior surface 34 of the side panel 20 form attachment points 44. The attachment points 44 are disposed within the cavity 38 and spaced apart from the interior surface 34 of the side panels 20. As discussed below, the connectors 50 detachably engage two attachment points 44 on opposed web members 40, which position the interior surfaces 34 of the side panels 20 at a desired separation distance and support the side panels 20 when the concrete is poured into the cavity 38.

Referring now to FIG. 3, each web member 40 also preferably has an end plate 42 disposed adjacent the exterior surface 32 of the side panel 20. The end plates 42 are substantially rectangular in plan view. Each end plate 42 of the web members 40 are completely disposed within a portion of one respective side panel 20. That is, the end plates 42 are located slightly below the exterior surface 32 of, or recessed within, the side panel 20, preferably at a distance of one-quarter (¼) of an inch from the exterior surface 32. This position allows for easily smoothing the surface of the side panels 20 without cutting the end plate 42 should the concrete, when poured, create a slight bulge in the exterior surface 32 of the side panels 20. Alternatively, the end plates 42 can abut the exterior surface 32 of panels. It is also preferred in the first embodiment that each end plate 42 is oriented substantially upright and disposed substantially parallel to the exterior surface 32 of the side panel 20.

Similar to the end plate 42, the attachment points 44 are also oriented substantially upright so that one attachment point 44 is disposed above another attachment point 44. As best shown in FIGS. 2 and 3, each of the web members 40 has four spaced-apart attachment points 44, in which the attachment points 44 for each web member 40 are vertically disposed within the cavity 38 in a substantially linear relationship. The attachment points 44 are placed in two groups—a top group of two attachment points 44 and a bottom group of two attachment points 44. Adjacent attachment points 44 in the two groups are spaced apart a first distance from each other, preferably approximately two and an eighth (2⅛) inches apart between center points. In addition, the closest attachment points 44 of the two groups, i.e., the lowermost attachment point 44 of the top group and the uppermost attachment point 44 of the bottom group, are spaced apart a second distance from each other. The second distance, which is approximately six (6) inches in the preferred embodiment, is more than double and almost triple the first distance. As one skilled in the art will appreciate, the number of attachment points 44 used for each web member 40 can be varied based on factors such as the dimensions of the side panels 20 and the wall strength or reinforcement desired.

The design of the attachment points 44 is an improvement over prior art systems, which lack multiple mounting points for attaching an interconnecting device. The side panels 20 and web members 40 in the present invention can be cut horizontally over a wide range of heights to satisfy architectural requirements, such as leaving an area for windows, forming odd wall heights, and the like, and still have at least two attachment points 44 to maintain structural integrity of the wall. Prior art systems, in contrast, lose structural integrity if cut horizontally, thus requiring extensive bracing to resist collapsing when concrete is poured into the cavity 38 between the panels.

Referring again to FIGS. 1 and 2, the attachment points 44 of the web members 40 extend into the cavity 38 and the attachment point 44 of each web member 40 formed within one side panel 20 is spaced apart from the attachment points 44 of the web members 40 formed within the opposed side panel 20. Thus, the web members 40 preferably do not directly contact each other; instead, each attachment point 44 independently engages the connector 50 that interconnects the web members 40 and, accordingly, the side panels 20.

Figure 4:
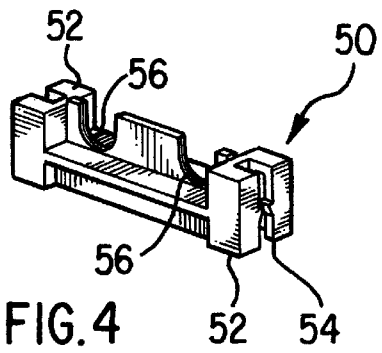
FIG. 4 is a perspective view of the connector in FIG. 3.

Referring now to FIG. 4, the connector 50 has opposed ends 52 and a length extending therebetween. The ends 52 of the connector 50 are of a shape to complementarily and removably engage the attachment point 44 of two respective web members 40 within opposed panels. As best shown in FIG. 5, the attachment point 44 is substantially rectangular and flat and, as best shown in FIG. 4, each end 52 of the connector 50 has a track 54 into which the rectangular member is slidably received.

To vary the width of the cavity 38 (i.e., the separation between the interior surfaces 34 of the opposed side panels 20), different connectors 50 can have varying lengths. The width of the cavity 38 can be two (2), four (4), six (6), eight (8) inches or greater separation. Different connectors 50 are sized accordingly to obtain the desired width of the cavity 38. Also, as one skilled in the art will appreciate, the fire rating, sound insulation, and thermal insulation increase as the width of the cavity 38, which is filled with concrete, increases.

Referring now to FIGS. 2 and 4, the connectors 50 also preferably define an aperture 56 of a size to complementary receive a re-bar (not shown) therein. The re-bar provides reinforcing strength to the formed wall. The diameter of the re-bar can be one quarter (¼) inch or other dimension as required for the necessary reinforcement, which depends on the thickness of the concrete wall and the design engineering requirements. The connectors 50 preferably have two apertures 56 and re-bar can be positioned in either both of the apertures 56 before the concrete is poured into the cavity 38. The apertures 56 can be designed so that the re-bar is securably snapped into place for ease of assembly.

The web members 40 and connectors 50 are preferably constructed of plastic, more preferably high-density polyethylene, although polypropylene or other suitable polymers may be used. Factors used in choosing the material include the desired strength of the web member 40 and connector 50 and the compatibility of the web member 40 with the material used to form side panels 20. Another consideration is that the end plates 42 should be adapted to receive and frictionally hold a metal fastener, such as a nail or screw, therein, thus providing the "strapping" for a wall system that provides an attachment point 44 for gypsum board (not shown), interior or exterior wall cladding (not shown), or other interior or exterior siding (not shown). Thus, the web members 40 function to align the side panels 20, hold the side panels 20 in place during a concrete pour, and provide strapping to connect siding and the like to the formed concrete wall.

One skilled in the art will appreciate that a plurality of side panels 20 can be longitudinally aligned to form a predetermined length and be vertically stacked to form a predetermined height. For example, as shown in FIG. 1, the first end 28 of one side panel 20 abuts the second end 30 of another side panel 20 and the bottom end 26 of one side panel 20 is disposed on the top end 24 of another side panel 20. Thus, a series of side panels 20 can be aligned and stacked to form the concrete system 10 into which concrete C is poured to complete the wall. One consideration, however, is that the side panels 20 are not vertically stacked too high and filled at one time so that the pressure on the bottom side panel 20 is greater than the yield strength of the web members 40 or EPS side panels 20. Instead, the stacked wall can be filled and cured in stages so that the pressure is not excessive on the lower side panels 20.

To facilitate the stacking of the components, the side panels 20 are optionally provided with a series of projections 35 and indentations 37 that complementarily receive offset projections 35 and indentions 37 from another side panel 20. The projections 35 and indentations 37 in the adjacent side panels 20 mate with each other to form a tight seal that prevents leakage of concrete during wall formation and prevents loss of energy through the formed wall.

Still referring now to FIG. 1, the present invention also uses comer sections 39.

Preferably, each comer section 39 forms a substantially right angle and concrete C is also poured into the comer section similar to the other sections of the concrete form system 10. Forty-five degree angle comer sections can also be used. Thus, the formed concrete wall is contiguous for maximum strength, as opposed to being separately connected blocks. Still another embodiment of the present invention, which is not shown, uses non-linear side panels 20 so that the formed wall has curvature instead of being straight.

The first embodiment of the present invention is an improvement over the prior art. Although other systems use connector 50 elements, the prior art lacks a web member 40 having an end plate 42, which provides a nailing/screwing strip adjacent the exterior surface 32 of the side panel 20, and has an attachment point 44 or similar connection projecting into the cavity 38 adjacent the interior surface 34. Moreover, the present invention uses less plastic and is, therefore, less expensive to manufacture.

Furthermore, in prior art systems, the panels are made so that large, thick, plastic connector elements slide down in a "T" slot formed within the inside surface of the panel itself. These prior art designs are structurally weak and the construction workers in the field have substantial difficulty avoiding breaking the panels while sliding the connector 50 element into place. Additionally, the prior art panels can break off from the cured concrete if any "pulling" occurs while mounting sheetrock or other materials onto the outer side of the panel. The present invention provides a stronger "interlocking" system between the side panels 20, the web member 40, and the connectors 50, which are imbedded within concrete in the cavity 38.

Referring now to FIGS. 5 and 5A the second embodiment of the present invention uses a single side panel 20 to construct the insulated concrete form, unlike the first embodiment that uses opposed side panels 20. The side panel 20 is horizontallydisposed so that the attachment points 44 extend upwardly. The interior surface 34 of the side panel 20 becomes the surface onto which concrete C is poured. Forms (not shown) are placed around the of the periphery, namely, the top end 24, bottom end 26, first end 28, and second end 30 of the side panel 20, to prevent the fluid concrete C from leaking off of the interior surface 34. Once the concrete C hardens by curing, the forms are removed and the side panel 20 and cured concrete slab creates a concrete structure shown in FIG. 5A. Unlike the first embodiment, only one side panel 20 is used and the portion opposite the side panel 20 is exposed to atmosphere, instead of contacting another, second side panel.

The concrete slab maintains its relative position against the interior surface 34 of the side panel 20 by the attachment points 44 of the web member 40. That is, by projecting beyond the interior surface 34 of the side panel 20, the web members 40 anchor the side panel 20 to the concrete slab. The connectors 50 can also be connected to the attachment points 44 to increase the surface area to which the concrete bonds. If the connectors 50 are the incorrect length, then they can easily be cut to the proper dimension at the construction site. Furthermore, re-bar can be positioned in the apertures 56 of the connectors 50 prior to pouring the concrete to strengthen the formed concrete structure.

The concrete structure, after curing, can be tilted upright so that concrete is on one side and the side panel 20 on the other side. In construction terminology, the concrete structure is called a "tilt-up" concrete wall. No prior art system has the ability to form such a concrete structure. The concrete structure can also be used as an insulated concrete floor, in which the panels are poured on the ground and after the concrete cures, placed on top of the tilt-up walls or the cast-in-place walls of the first embodiment. The second embodiment of the present invention can also be used to create roof panels. No insulated concrete form system exists in the prior art that can be used for tilt-up concrete walls, roof panels, or flooring because the prior art does not have a member extending partially beyond the interior surface of the side panel, but not extending all the way to a second, opposed panel. Nor is there a prior art form system that can be used for floor/ceiling and roof panels which can be cast as separate structural "panels" on the ground, and then lifted up to be placed on top of walls to form floors/ceilings or roofs.

Furthermore, the second embodiment of the present invention can be used to construct an entire building made of insulated concrete walls ("cast in place" or "til-tup"), floors, ceilings, and roof panels. The present invention is a major advancement in technology because no prior art concrete form system can build an entire building. The present invention additionally improves the speed of construction and lowers cost compared with the prior art.

Although the present invention has been described with reference to specific details of certain embodiments thereof, it is not intended that such details should be regarded as limitations upon the scope of the invention except as and to the extent that they are included in the accompanying claims.

What is claimed is:

1. A method of constructing a concrete structure, comprising the steps of:

a. disposing an interior surface of one side panel upright and substantially horizontal, said one side panel including a web member partially disposed therein so that a portion of said web member extends through the interior surface thereof, wherein said web member is constructed of a plastic comprising high-density polyethylene or polypropylene;

b. pouring fluid concrete onto the interior surface of said one side panel so that the portion of said web member that extends through the interior surface of said one side panel is disposed within said poured concrete; and c. allowing said poured concrete to substantially cure so that said poured concrete becomes a concrete slab having a first side contacting the interior surface of said one side panel and an opposed second side wherein the portion of said web member that extends through the interior surface of said one side panel is disposed within said concrete slab to assist in maintaining contact between said concrete slab and said one side panel so that said joined concrete slab and one side panel become a concrete structure.

2. The method of claim 1, further comprising the step of tilting said concrete structure to be disposed substantially upright.

* * * * *